US007010891B1

(12) United States Patent
Clark et al.

(10) Patent No.: US 7,010,891 B1
(45) Date of Patent: Mar. 14, 2006

(54) HAUNCH ASSEMBLY FOR SUPPORTING A CONCRETE SLAB AND METHOD OF MAKING THE HAUNCH ASSEMBLY

(76) Inventors: Ryan Clark, 10443 Brookhollow Cir., Highlands Ranch, CO (US) 80126; Lawrence J. Hug, 11304 Canary La., Parker, CO (US) 80138; Michael J. Martinez, 2587 S. Vrain Ct., Denver, CO (US) 80219

( * ) Notice: Subject to any disclaimer, the term of this patent is extended or adjusted under 35 U.S.C. 154(b) by 326 days.

(21) Appl. No.: 10/114,719

(22) Filed: Apr. 2, 2002

(51) Int. Cl.
*E04B 1/38* (2006.01)
*E04B 5/00* (2006.01)
*E04C 3/20* (2006.01)
*E04C 5/00* (2006.01)

(52) U.S. Cl. ..... 52/283; 52/125.5; 52/285.2; 52/274; 52/289; 52/294

(58) Field of Classification Search ..... 52/125.4, 52/125.5, 283, 285.2, 262, 274, 289, 294, 52/250, 251, 252, 189
See application file for complete search history.

(56) References Cited

U.S. PATENT DOCUMENTS

| | | | | |
|---|---|---|---|---|
| 2,127,973 | A * | 8/1938 | Isett | |
| 2,187,912 | A * | 1/1940 | Peirce | |
| 2,423,936 | A * | 7/1947 | Henderson | |
| 2,569,669 | A * | 10/1951 | Henderson | |
| 3,216,157 | A * | 11/1965 | Pinter | |
| 3,405,486 | A * | 10/1968 | Fagenstrom | 52/190 |
| 3,804,260 | A * | 4/1974 | Crowley | |
| 3,875,708 | A * | 4/1975 | Thorsnes | |
| 3,897,663 | A * | 8/1975 | Gaul | |
| 3,913,287 | A * | 10/1975 | Chapman | |
| 4,302,915 | A * | 12/1981 | Stocks | |
| 4,619,096 | A * | 10/1986 | Lancelot, III | |
| 4,750,306 | A * | 6/1988 | Granieri | |
| 5,261,198 | A * | 11/1993 | McMillan | |
| 5,386,675 | A * | 2/1995 | Baur et al. | |
| 5,492,437 | A * | 2/1996 | Ortiz | |
| 5,649,782 | A * | 7/1997 | Frohlich et al. | |

FOREIGN PATENT DOCUMENTS

| | | | |
|---|---|---|---|
| EP | 0 039 661 A2 | * | 4/1981 |
| JP | 6-33472 | * | 2/1994 |
| JP | 6-180016 | * | 6/1994 |
| WO | 85/03099 | * | 7/1985 |

* cited by examiner

*Primary Examiner*—Robert Canfield
(74) *Attorney, Agent, or Firm*—Edwin H. Crabtree; Ramon L. Pizarro

(57) ABSTRACT

A foundation haunch assembly used for attachment to a foundation wall and a method of making the haunch assembly using a concrete block machine. The haunch assembly includes a concrete haunch having an upper portion, a center portion and a lower portion. The upper portion of the haunch includes a flat top surface adapted for receiving a portion of a pre-cast concrete slab, stairs, stoops, poured in place concrete slab or other building structure thereon. Also, the upper portion includes an internal horizontal metal support rod along the length thereof. One end of the support rod is threaded to one end of a threaded coupling. The foundation haunch assembly also includes a variable length foundation bolt with a threaded end threaded into an opposite end of the threaded coupling. The foundation bolt is adapted for receipt through a hole in a portion of a vertical foundation wall. An opposite threaded end of the foundation bolt is attached to a nut. The nut is used for tightening and securing the foundation bolt and the concrete haunch to a side of the foundation wall.

16 Claims, 2 Drawing Sheets

HAUNCH ASSEMBLY FOR SUPPORTING A CONCRETE SLAB AND METHOD OF MAKING THE HAUNCH ASSEMBLY

BACKGROUND OF THE INVENTION (a) Field of the Invention

This invention relates to building support haunch assemblies and more particularly, but not by way of limitation, to a foundation haunch assembly having a concrete haunch for adjustable attachment to a foundation wall and method of making the haunch assembly. One or more of the haunches are used for supporting poured in place horizontal concrete slabs, stairs, stoops, pre-cast concrete slabs and similar structures.

(b) Discussion of Prior Art

Heretofore, a building contractor often make foundation haunches integral to the foundation during its construction, which required additional time and expense in forming and pouring the haunches on site. Also, the contractor could use foundation haunches having internal rebar supports and an outwardly extending fixed length bolt. The bolt was inserted through a bolt hole in the side of a foundation wall on a building site. If the width of the foundation wall was the same or greater than the length of the outwardly extending bolt then obviously the haunch could not be attached to the wall. The subject invention solves the problem of attaching a concrete haunch to different width foundation walls or forming haunches integral to the foundation.

In U.S. Pat. No. 3,599,929 to Holley et al., a bracket assembly is disclosed having a plurality of rod members used with stair and riser forms for receiving poured concrete. In U.S. Pat. No. 3,462,106 to Buyken, a waler bracket is illustrated for attaching to the side of a concrete form. In U.S. Pat. No. 4,027,711 to Tummarello, an adjustable fastener for attaching heavy precast concrete panels on walls or floors is described. In U.S. Pat. No. 4,239,173 to Sawyer, an improved concrete form with tie rods is disclosed. The tie rods shown in this patent are designed to be quickly broken following the casting of concrete.

None of the above mentioned prior art patents specifically disclose the unique features, structure and function of the subject foundation haunch assembly with a concrete haunch and a removable variable length foundation bolt as described herein.

SUMMARY OF THE INVENTION

In view of the foregoing, it is a primary objective of the subject invention is to provide a concrete haunch combined with a variable length foundation bolt for securing the haunch to foundation walls having different thickness. Also, the concrete haunch can be installed at any height to adjust for building grade.

Another object of the method of the invention is the concrete haunch assemblies can be mass produced using a standard concrete block machine with zero slump concrete or a light weight zero slump concrete. Also, the haunches can be palletized and shipped to a building site when ordered by a contractor or building owner.

Yet another object of the new haunch is consistent integrity of construction and appearance of the haunch for installation below and above grade. The haunches can be made in different sizes for holding various load pressures. Also, the haunches can be made using various colors and block finishes for different types of architectural designs.

Still another object of the concrete haunch is it can be used for new building construction, for building remodel, home improvement and various other applications.

A further object of the invention is one or more haunches can be used not only for supporting different types and sizes of pre-cast concrete slabs, poured in place concrete slabs, stairs and stoops, but also used for supporting other types of structures adjacent to the foundation wall.

Another object of the new haunch is the use of a haunch handle, which can be threadably attached to a threaded coupling in the haunch for providing a connecting point to the foundation wall or a poured in place concrete slab or other poured structure.

The foundation haunch assembly includes an attachable concrete haunch having an upper portion, a center portion and a lower portion. The upper portion includes a flat top surface adapted for receiving a portion of a pre-cast concrete slab or other building structure thereon. Also, the upper portion includes an internal horizontal metal support rod along the length thereof. One end of the support rod is threaded to one end of a threaded coupling. The haunch assembly also includes a variable length foundation bolt with one end threaded into an opposite end of the threaded coupling. The foundation bolt is adapted for receipt through a hole in a portion of a vertical foundation wall. An opposite threaded end of the foundation bolt is attached to a nut. The nut is used for tightening and securing the foundation bolt and the concrete haunch to a side of the wall. The concrete haunch also includes a vertical first end, which is disposed and compressed against the side of the foundation when the haunch is secured thereto and an angled second end for providing strength and integrity to the concrete haunch.

These and other objects of the present invention will become apparent to those familiar with various types concrete haunches and concrete supports used for holding building structures thereon when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate preferred embodiments of the present invention according to the best modes presently devised for the practical application of the principles thereof, and in which.

DESCRIPTION OF THE PREFERRED EMBODIMENTS

Figure 1:
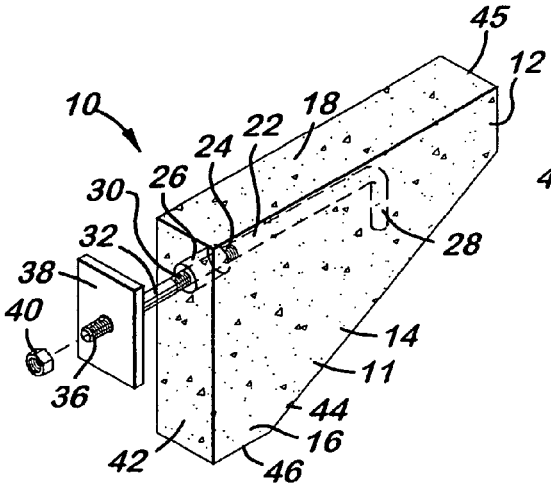
FIG. 1 is a perspective view of the subject foundation haunch assembly with a concrete haunch and a variable length foundation bolt threaded into a first end of the haunch.
Figure 2:
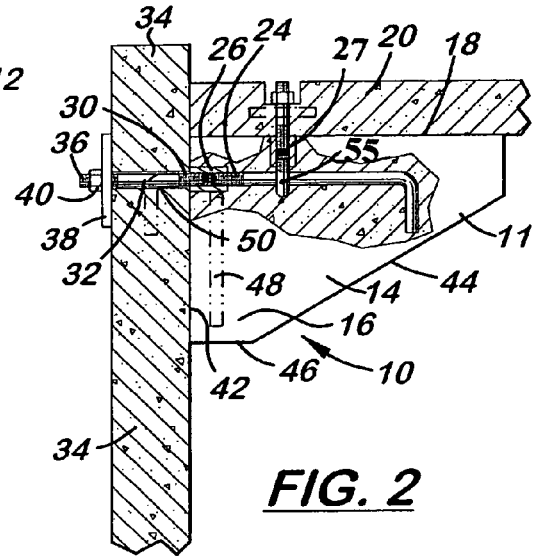
FIG. 2 is a side view of the concrete haunch attached to a side of a foundation wall. The haunch is shown with a portion of a concrete slab supported thereon.
Figure 3:
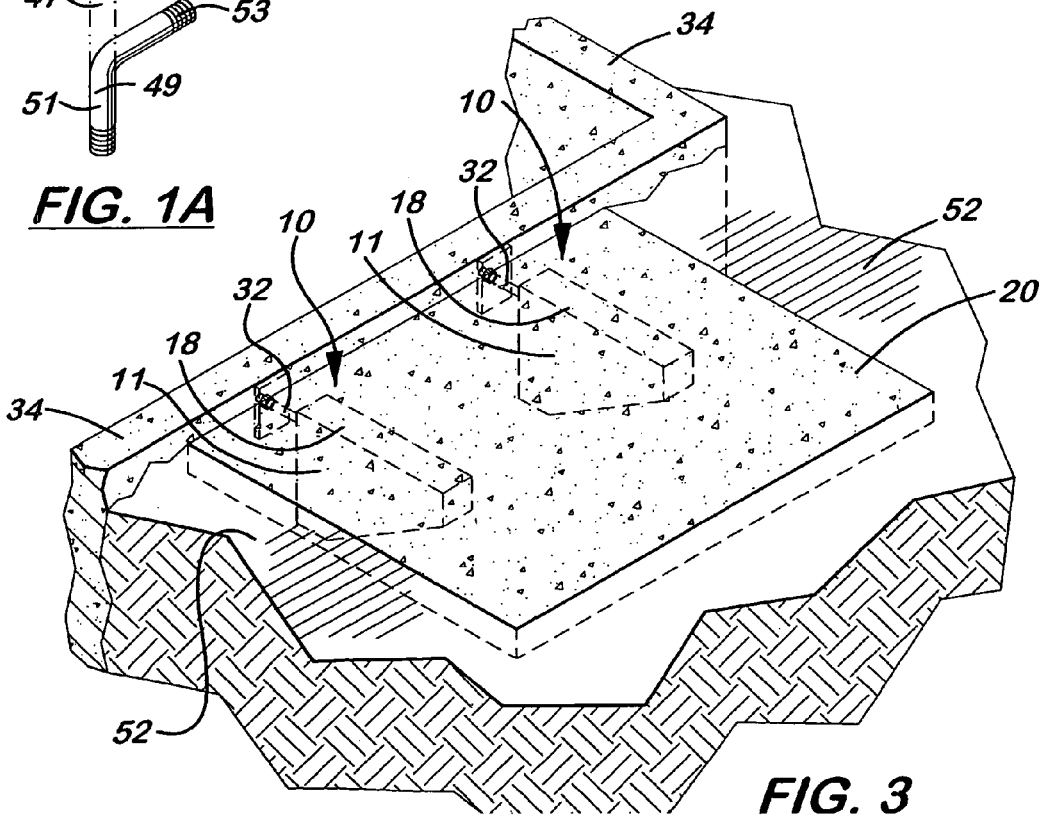
FIG. 3 is a perspective view of a pair of concrete foundation haunch assemblies attached to the foundation wall and supporting a concrete slab structure disposed next to the foundation wall.

In FIG. 1, a perspective view of the subject foundation haunch assembly is shown having a general reference numeral 10. The foundation haunch assembly 10 includes a concrete haunch 11 having an upper portion 12, a center portion 14 and a lower portion 16. The upper portion 12 includes a flat top surface 18 adapted for receiving a portion of a pre-cast concrete slab 20. While the pre-cast concrete slab 20 is shown in the drawings, it should be keep in mind that the haunch assembly 10 can be used equally well with stairs, stoops, poured in place concrete slabs or other building structure. The concrete haunch 11 is made of zero slump or light weight zero slump concrete. The concrete slab 20 is shown in FIGS. 2 and 3. Also, the upper portion 12 includes an internal horizontal metal support rod 22 along the length thereof. One end 24 of the support rod 22 is threaded into one end of a first threaded coupling 26. An opposite end 28 of the support rod 22 is bent 90 degrees for added strength and to prevent the rod from turning or rotating inside the haunch 11.

The haunch assembly 10 also includes a variable length foundation bolt 32 having an end 30 threaded into an opposite end of the first threaded coupling 26. The variable length foundation bolt 32 is adapted for receipt through a portion of a vertical foundation wall 34. An opposite threaded end 36 of the foundation bolt 32, along with a bearing plate 38, is attached to a nut 40. The nut 40 is used for tightening and securing the foundation bolt 32 and the haunch 10 to a side of the foundation wall 34. The variable length foundation bolt 32, for example, can come in various lengths depending on the thickness of the foundation wall 34.

The concrete haunch 11 also includes a vertical first end 42, an angled second end 44 and a flat bottom surface 46. Further and if necessary, the haunch 11 can include a vertical shear rod 48 shown in dashed lines in FIG. 2. The shear rod 48 will provide for additional strength to the haunch when the haunch 11 is placed under a heavy shear load.

Figure 1A:
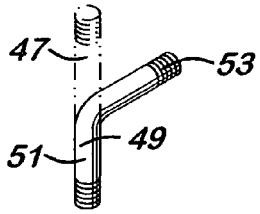
FIG. 1A is a perspective view of a haunch handle for releasable attachment to the concrete haunch for ease in carrying the haunch.

In FIG. 1A, a "L" shaped haunch handle 49 is shown. The handle 49 includes a hand grip portion 51 and a threaded end portion 53. The threaded end portion 53 is screwed into the coupling 26 when lifting and carrying the haunch assembly 10. Because the haunch can vary in size, the weight may be in a range of 50 to 100 pounds and greater. Obviously, the haunch handle 49 can be used if desired for ease in handling and during installation. Also shown in this drawing is the handle 49 with an added arm 47, shown in dashed lines, for forming a "T" shaped handle configuration.

In FIG. 2, a side view of the foundation haunch assembly 10 is shown secured to one side of a foundation wall 34. A portion of the concrete slab 20 is shown supported on the flat top surface 18 of the concrete haunch 11. In this drawing, a portion of the upper portion 12 is cut away to expose the one end 24 of the support rod 22 threaded into the threaded coupling 26.

In operation, the foundation bolt 32 is inserted in a hole 50 drilled through the foundation wall 34. The first end 42 is then placed next to the side of the foundation wall and the threaded end 30 of the bolt 32 is threaded inside the coupling 26. The concrete haunch 11 is then tightened by placing the bearing plate 38 around a portion of the bolt 32 and threading the nut 40 on the opposite threaded end 36. As the nut 40 is tightened, the vertical first end 42 of the concrete haunch 11 is compressed against the side of the foundation wall 34. Also if required or needed, the vertical first end 42 can be coated with a construction adhesive 43 to prevent shear or movement along the length of the first end 42 compressed against the side of the foundation wall 34.

As an added feature of the subject invention, a "J" shaped attachment rod 55 can be attached at one end to the support rod 22. The other end is threaded into a second threaded coupling 27, next to the flat top surface 18 of the concrete haunch 11. When the attachment rod 55 is used, a hole is drilled through the concrete slab 20, a concrete step or like structure and another variable length bolt 32 is inserted through the hole and secured to the threaded coupling 27. Obviously, the attachment rod 55 is used when it is necessary to attach a concrete structure to the top of the concrete haunch assembly 10.

Also shown in this drawing is the used of the haunch handle 49, having either a "L" shaped configuration, a "T" shaped configuration as shown in FIG. 1A or other configuration, used as a connecting point when the foundation wall 34 or the concrete slab 20. The haunch handle 49 is shown in dashed lines and connected to the first threaded coupling 26. In this example, the haunch handle 49 would replace the use of the foundation bolt 32 and incorporated into the foundation wall as a connecting point during the pouring of the wall. Also, a second haunch handle 49 is shown in dashed lines and connected to the second threaded coupling 26. In this example, the second haunch handle 49 would replace the second variable length bolt 32 and incorporated into a poured in-place concrete slab as a connecting point during the pouring of the slab. The haunch handles 49 can be used equally well in attaching stairs, stoops and other structures to the concrete assembly 10.

In FIG. 3, a perspective view of a pair of haunch assemblies 10 are illustrated supporting the concrete slab 20 disposed next to a foundation wall 34 with a backfill of ground 52 compacted around the perimeter of the wall and slab. In this drawing, the haunch assemblies 10 are adjusted on the wall 34 so that the top of the slab 20 is slightly below the top of the foundation wall. While the two haunch assemblies 10 are shown, it can be appreciated that any number of haunches can be used with different spacing for supporting a building structure next to a foundation wall. The concrete slab 20 is not attached to the haunches so that it is free floating should the ground expand. Also, if the ground 52 should shrink or consolidate adjacent the foundation wall 34, the haunch assemblies 10 will provide the necessary support for the slab 20.

Figure 4:
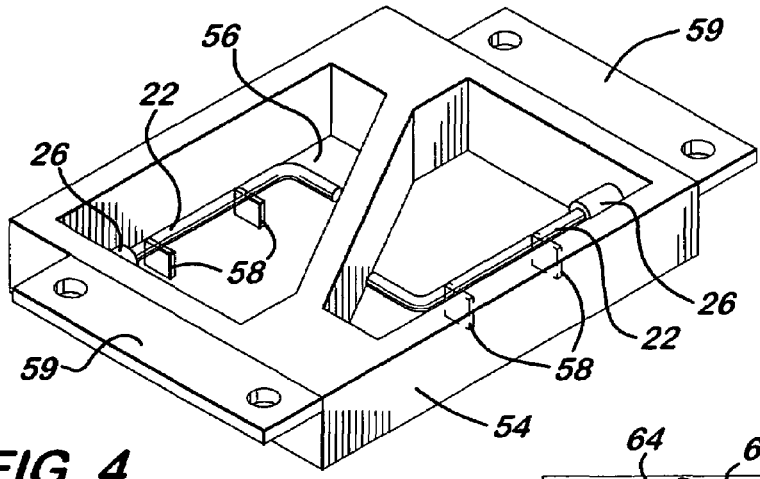
FIG. 4 is a perspective view of a female haunch assembly mold used with a concrete block machine in pouring a pair of the concrete haunches.

In FIG. 4, a perspective view of a female haunch assembly mold 54 is illustrated for mass producing the haunch assembly 10 in a standard concrete block machine. In this drawing, the mold 54 is shown with a pair of mold cavities 56 therethrough with the metal support rod 22 and attached threaded coupling 26 suspended in the cavities on small mold chairs 58. The mold 54 also includes a pair of head support plates 59, which are used for securing the mold to a movable head of the block machine. While the female mold 54 is shown for forming a pair of haunch assemblies 10, it can be appreciated that a single mold cavity can be used or any number of mold cavities depending on the size of the mold used and the size of the concrete block machine.

Figure 5:
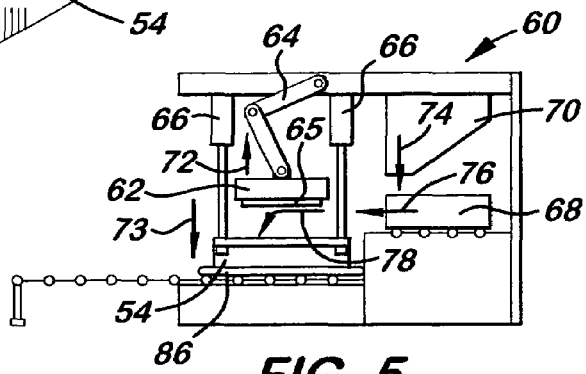
FIG. 5 is a side view of a standard concrete block machine with a moveable head in a raised position, a pair of moveable cylinders for lowering and raising the female haunch assembly mold and a feed drawer disposed under a concrete hopper.

In FIG. 5, a side view of a standard concrete block machine is shown having a general reference numeral 60. The concrete block machine 60 includes a moveable head 62 with linkage 64 for raising and lowering the head 62. Also, the bottom of the head includes a male mold 65 attached thereto for inserting into the top of the female mold 54. The female mold 54 is attached to a pair of moveable cylinders 66 used for raising and lowering the mold 54. Also, the block machine 60 includes a feed drawer 68 disposed under a concrete hopper 70 for receiving the zero slump or light weight zero slump concrete and feeding it into the top of the female mold 54.

In this drawing, the linkage has moved the head 62 in a raised position, as indicated by arrow 72 and the female mold in a lower position, as indicated by arrow 73. The hopper 70 is shown feeding the concrete into the feed drawer 68, as indicated by arrow 74. When the feed drawer 68 has been filled, it is moved above the female mold 54, as indicated by arrow 76. At this time, the concrete drops into and fills the mold cavities 56 of the mold 54, as indicated by arrow 78.

Figure 6:
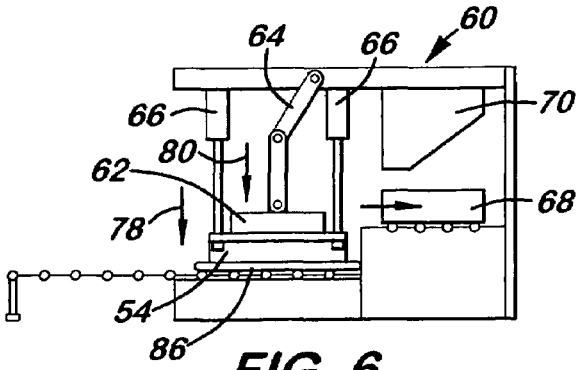
FIG. 6 is another side view of the concrete block machine with the moveable head in a lowered position on top of the female haunch assembly mold for compacting and vibrating the concrete in the female mold.

In FIG. 6, another side view of the concrete block machine 60 is shown with the moveable head 62 in a lowered position, as indicated by arrow 80. The male mold 65 is inserted into an upper portion of the cavities 56 of the female mold 54. The head 62 now compresses and vibrates the concrete in the female mold. The feed drawer 68 is shown moved back and positioned under the concrete hopper 70, as indicated by arrow 82.

Figure 7A:
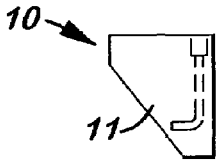
FIG. 7A illustrates a top view of one of the completed haunch assemblies shown in FIG. 7.
Figure 7:
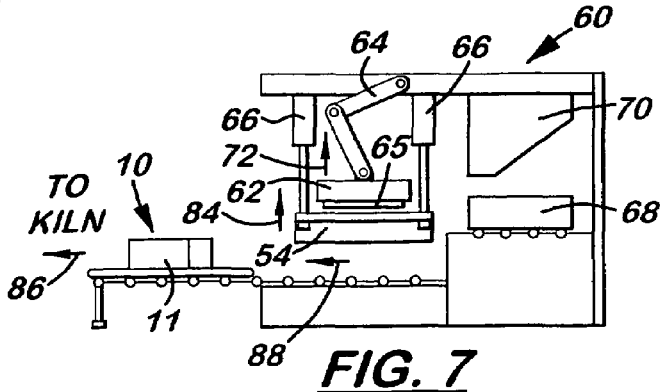
FIG. 7 is still another side view of the block machine with moveable head in a raised position and the female haunch assembly mold in a raised position. The completed haunch assembly is shown on a conveyor pallet moved to the left and having exited from the concrete block machine.

In FIG. 7, still another side view of the block machine 60 is shown. In this drawing, the making of the haunch assemblies 10 is completed and the moveable head 62 is shown in a raised position, as indicated by arrow 72. Also, the female haunch assembly mold 54 is shown in a raised position, as indicated by arrow 84. The completed haunch assemblies 10 are shown on a conveyor pallet 86 moved to the left, as indicated by arrow 88, and away from the concrete block machine 60. The haunch assemblies 10 are now ready to be sent to a kiln for heating and curing of the concrete before being sent to a job site.

In FIG. 7A, a top view of one of the completed haunch assemblies 10 is shown as illustrated in FIG. 7.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

What is claimed is:

1. A foundation haunch assembly used for attachment to a foundation wall, the haunch assembly used for supporting a building structure, the haunch assembly comprising:

a concrete haunch having an upper portion, a center portion and a lower portion, the upper portion includes a flat top surface adapted for receiving a portion of the building structure thereon, said concrete haunch also having a vertical first end, a second end, an angled side for added strength to said concrete haunch and a flat bottom surface, the vertical first end adapted for receipt against a side of the foundation wall;

an internal horizontal metal support rod disposed in the upper portion of said concrete haunch;

a first threaded coupling disposed in the upper portion of said concrete haunch, one end of said support rod attached to one end of said first threaded coupling; and a variable length foundation bolt, said foundation bolt adapted for receipt through a hole in a portion of the foundation wall, one end of said foundation bolt threaded into an opposite end of said first threaded coupling.

2. The haunch assembly as described in claim 1 wherein an opposite end of said support rod is bent downwardly 90 degrees inside said concrete haunch for providing additional strength to said concrete haunch and preventing movement and rotation of said support rod inside said concrete haunch.

3. The haunch assembly as described in claim 1 further including a first haunch handle, said first haunch handle having a hand grip portion and a threaded end portion, the threaded end portion releaseably attached to one end of said first threaded coupling, said first haunch handle for carrying said concrete haunch.

4. The haunch assembly as described in claim 1 further including a vertical shear rod disposed inside said concrete haunch and next to the vertical first end of said concrete haunch, said shear rod providing additional strength to said concrete haunch and reducing the possibility of shear inside said concrete haunch.

5. The haunch assembly as described in claim 1 further including a "J" shaped attachment rod, one end of said attachment rod secured on a portion of said support rod, another end of said attachment rod threaded into a second threaded coupling disposed next to the flat top surface of said concrete haunch.

6. The haunch assembly as described in claim 5 further including a second haunch handle having one end attached to said second threaded coupling, said second haunch handle adapted for providing a connecting point to the building structure.

7. A foundation haunch assembly used for attachment to a foundation wall, the haunch assembly used for supporting a building structure, the haunch assembly comprising:

a concrete haunch having an upper portion, a center portion and a lower portion, the upper portion includes a flat top surface adapted for receiving a portion of the building structure thereon;

an internal horizontal metal support rod disposed in the upper portion of said concrete haunch;

a first threaded coupling disposed in the upper portion of said concrete haunch, one end of said support rod attached to one end of said first threaded coupling;

a variable length foundation bolt, said foundation bolt adapted for receipt through a hole in a portion of the foundation wall, one end of said foundation bolt threaded into an opposite end of said first threaded coupling; and a "J" shaped attachment rod, one end of said attachment rod secured on a portion of said support rod, another end of said attachment rod threaded into a second threaded coupling disposed next to the flat top surface of said concrete haunch.

8. The haunch assembly as described in claim 7 wherein an opposite end of said support rod is bent downwardly 90 degrees inside said concrete haunch for providing additional strength to said concrete haunch and preventing movement and rotation of said support rod inside said concrete haunch.

9. The haunch assembly as described in claim 7 wherein said concrete haunch includes a vertical first end, a second end, an angled side for added strength to said concrete haunch and a flat bottom surface, the vertical first end adapted for receipt against a side of the foundation wall.

10. The haunch assembly as described in claim 7 further including a first haunch handle, said first haunch handle having a hand grip portion and a threaded end portion, the threaded end portion releaseably attached to one end of said first threaded coupling, said first haunch handle for carrying said concrete haunch.

11. The haunch assembly as described in claim 7 further including a vertical shear rod disposed inside said concrete haunch and next to a vertical first end of said concrete haunch, said shear rod providing additional strength to said concrete haunch and reducing the possibility of shear inside said concrete haunch.

12. The haunch assembly as described in claim 7 further including a second haunch handle having one end attached to said second threaded coupling, said second haunch handle adapted for providing a connecting point to the building structure.

13. A foundation haunch assembly used for attachment to a foundation wall, the haunch assembly used for supporting a building structure, the haunch assembly comprising:

a concrete haunch having an upper portion, a center portion and a lower portion, the upper portion includes a flat top surface adapted for receiving a portion of the building structure thereon;

an internal horizontal metal support rod disposed in the upper portion of said concrete haunch;

a first threaded coupling disposed in the upper portion of said concrete haunch, one end of said support rod attached to one end of said first threaded coupling;

a variable length foundation bolt, said foundation bolt adapted for receipt through a hole in a portion of the foundation wall, one end of said foundation bolt threaded into an opposite end of said first threaded coupling; and a vertical shear rod disposed inside said concrete haunch and next to a vertical first end of said concrete haunch, said shear rod providing additional strength to said concrete haunch and reducing the possibility of shear inside said concrete haunch.

14. The haunch assembly as described in claim 13 wherein an opposite end of said support rod is bent downwardly 90 degrees inside said concrete haunch for providing additional strength to said concrete haunch and preventing movement and rotation of said support rod inside said concrete haunch.

15. The haunch assembly as described in claim 13 wherein said concrete haunch includes a vertical first end, a second end, an angled side for added strength to said concrete haunch and a flat bottom surface, the vertical first end adapted for receipt against a side of the foundation wall.

16. The haunch assembly as described in claim 13 further including a first haunch handle, said first haunch handle having a hand grip portion and a threaded end portion, the threaded end portion releaseably attached to one end of said first threaded coupling, said first haunch handle for carrying said concrete haunch.

* * * * *